US005460495A

United States Patent [19]

Matsui et al.

[11] Patent Number: 5,460,495

[45] Date of Patent: Oct. 24, 1995

[54] SCREW ROTOR FOR FLUID HANLING DEVICES

[75] Inventors: Akira Matsui, Ibaragi; Takayuki Kishi, Miura; Toshio Nishio, Ibaragi; Keisuke Kasahara, Toyko, all of Japan

[73] Assignee: Mayekawa Mfg. Co., Tokyo, Japan

[21] Appl. No.: 132,928

[22] Filed: Oct. 7, 1993

[51] Int. Cl.[6] ..... F01C 1/16

[52] U.S. Cl. ..... 418/201.3; 418/150

[58] Field of Search ..... 418/201.3, 150

[56] References Cited

U.S. PATENT DOCUMENTS 4,679,996 7/1987 Tanaka et al. ..... 418/201.3
4,938,672 7/1990 Ingalls ..... 418/201.3
5,058,907 2/1992 Yoshimura ..... 418/201.3

OTHER PUBLICATIONS

"The Calculus with Analytic Geometry, Fourth Edition", by Louis Leithold, Harper & Row Publishers, 1981.

*Primary Examiner*—Richard A. Bertsch
*Assistant Examiner*—Charles G. Freay
*Attorney, Agent, or Firm*—Klima & Hopkins

[57] ABSTRACT

A screw rotor for fluid handling devices configured to reduce the area of blowholes virtually without relationship to the length of the sealing line by selecting specific profile shapes of the addendum of the female rotor and the dedendum on male rotor. Further, the screw rotor configuration eliminates semi-occluded pockets forming between the addendum of the female rotor and the dedendum of the male rotor.

10 Claims, 5 Drawing Sheets

CROSS SECTIONAL AREA OF BLOWHOLE

SCREW ROTOR FOR FLUID HANLING DEVICES

FIELD OF THE INVENTION

This invention relates to a screw rotor for fluid handling devices such as compressors, blowers, expanders, liquid transmission pumps, and the like. More specifically, the present invention is directed to a screw rotor comprising male and female rotors, which engage with each other as they rotate with the female rotor having an addendum on its threads located at the outer edge of the pitch circle.

BACKGROUND OF THE INVENTION

There exist a number of fluid handling devices employing a pair of cooperating screw rotors. Generally, these devices include a casing with a pair of operating chambers defined by two parallel bores (e.g. cylindrical bores). A male rotor and female rotor are disposed in the parallel bores, and cooperate together during operation. For example, in a compressor one bore provides a common intake port and the other bore provides a high pressure discharge port. Typically, the male and female rotors have a wrapping angle of less than 360°.

The greater part, if not all, of the lands and troughs on the male rotor lie outside the pitch circle, while the greater part, if not all, of the troughs and lands on the female rotor which engage with the aforesaid male rotor lie within the pitch circle. Generally, the male rotor will have four (4) lands, and the female rotor will have six (6) lands.

A "land" for purposes of the present invention is defined as the protruding portion of each tooth, and located between adjacent troughs. A "trough" for purposes of the present invention is defined by the concave portion located between adjacent lands.

In related screw rotor fluid handling devices, the set of rotors are driven synchronously by means of synchronized gears. In some devices, the two rotors are driven in such a way that they do not come in contact with each other (i.e. non-contact type). In other devices, one of the rotors (i.e. the male rotor) serves as a drive rotor and contacts with the other rotor (i.e.female rotor) imparting rotary torque thereto so that both rotors are rotated together.

However, in the related non-contact type fluid handling devices, the synchronized gears must operate with great precision in order to avoid direct contact between the rotors driving up the cost of manufacture.

For this reason, the majority of screw-type fluid handling devices currently in use employ a rotary scheme by which the rotors come in direct contact with each other. The tips of the lands on the female rotor extend beyond the pitch circle, forming addendum. The troughs located between adjacent teeth on the male rotor that engage with the addendum lie within the pitch circle, forming dedendum. This arrangement scheme has replaced most previous designs. The term "addendum" for purposes of the present invention refers to the tips of the lands, which extend beyond the pitch circle, and the term "dedendum" refers to the bases of the troughs between adjacent teeth located within the pitch circle.

This type of rotor arrangement is widely used in oil jet type rotor devices, however, its use is not limited to this type of application. It can also be used in oil-less type rotor devices.

These related fluid handling device encounter some problems during operation. For example, referring to the related device shown in FIG. 4, an addendum 21 is provided on a female rotor 2. This is a contact type compressor employing screw rotors of a type as disclosed in Japanese Patent Publication 56-17559. As the male and female rotors rotate together, the addendum 21 on female rotor 2 engages with and disengages from the base 11 of trough 13 of the male rotor 1. As the screw rotors rotate together, a pocket 4 initially forms between the surfaces of the teeth of both rotors and by plate 3, and then decreases in volume size as the rotors further rotate while an escape path 41 communicating with an escape chamber of pocket 4 becomes more narrow. This situation causes exit resistance in the operating fluid leaving pocket 4 resulting in the exit becoming semi-occluded. Eventually as the escape path 41 is closed down, the fluid is compressed in the pocket 4, and work required for compression of the trap fluid in the pocket 4 is wasted.

If it should happen that the fluid trapped in the pocket 4 contains an impurity such as oil from an oil jet mechanism, or operating fluid condenses within the pocket 4, not to mention the various trapped gases located in the pocket 4, significant vibration and noise can be generated when the fluid is compressed. Furthermore, as the work required for compression of trapped fluid is increased, the efficiency and reliability of the compressor will decrease substantially.

In Japanese Patent Publication 2-50319, a design is suggested whereby the addendum 21 on the female rotor 2 is provided with a curvature matching the profile of the base dedendum on the male rotor 1. However, with this rotor arrangement, a semi-occluded pocket 4 can still form as can be seen in FIG. 5, even though it is much smaller than the pocket 4 of the arrangement shown in FIG. 4. The perfect solution to one problem results in this unrelated problem in the arrangement shown in FIG. 5.

Another problem with existing related devices concerns the possibility of forming a blowhole. This situation can occur when a screw rotor device is constructed with a female rotor 2 having addendum 21 located beyond the pitch circle. Along the line of the seal between the tips of the lands on the male and female rotors and the cylindrical wall of the operating chamber, the apices of the V-shaped chambers coincide with corresponding points along the associated line on the bore of the corresponding operating chamber. Thus, different V-shaped chambers are completely sealed with respect to each other, and theoretically there are no blowholes.

However, when addendum 22 are provided on the aforementioned female rotor 2, as shown in FIG. 6, the points at which the cylindrical bores intersect cannot extend as far as the aforementioned pitch circle. Thus, a triangular ventilation hole known as a "blowhole" will be formed by one edge of point 5 of the intersection of the bores, the top of land 12 on male rotor 1, and the advancing flank of addendum 22 on female rotor 2. The term "flank" for purposes of the present invention refers to the side of either an advancing or retreating land.

To address this problem, Japanese Patent Publication 3-4757 proposes making the troughs on the female rotor 2 arcs, generated curves, or hyperbolae, while the curves of the advancing flanks which start at the bases of the troughs between teeth and end at addendum 22 would be unique curves, not arcs, whose radii would vary with the angle of the profiles. The lands on the male rotor 1 would be arcs or generated curves; the curves of the retreating flanks on the tops of the aforesaid lands would be unique curves, not arcs, whose radii would vary with the angle of the profiles. This would minimize the area of the aforementioned blowholes.

Generally, in screw rotor devices the length of the seal line varies inversely with the area of the blowholes. When the blowholes are minimized by matching the troughs on the female rotor 2 with the lands 12 on the male rotor 1 as in the related devices, it becomes extremely difficult to shorten the sealing line.

In Example 1 discussed above, the problem is addressed by having the angle $\gamma$ of the tangent to the retreating flank of the trough on the female rotor 2 approach 90°. However, as can be seen in FIG. 3, this does not sufficiently shorten the sealing line.

SUMMARY OF THE INVENTION

An object of the present invention is to provide a screw rotor configuration whose design reduces the area of blowholes more than in the existing configurations discussed above, and virtually without relationship to the length of the sealing line.

Another object of the present invention is to provide a screw rotor configuration that concerns the shape of addendum on female rotor and the shape of the dedendum on male rotor.

A further object of the present invention is to provide a screw rotor configuration in which, when the rotor configuration is employed in a compressor, the pocket 4 enclosed by the tooth surfaces of the two rotors and the surface of the chamber does not become semi-occluded, nor is the strength of female rotor diminished, nor is there a decrease in the theoretical displacement (theoretical draft, i.e., in which the aforesaid state of semi-occlusion is prevented).

The addendum of the female rotor comprises an advancing profile and a retreating profile. The advancing profile is defined by a cross section of the female rotor from the center of the crest of the addendum to the pitch circle on the advancing side relative to the direction of rotation ($O_1$–J–K–L). The retreating profile is defined by a cross section of the female rotor from the center of the crest of the addendum to the pitch circle on the retreating side relative to the direction of rotation (P–Q–R–s– $O_1$).

A first embodiment according to the present invention is an improvement on the advancing profile of the addendum on the female rotor to reduce the blowhole. This improvement is characterized in that the advancing profile includes at least three (3) arcs, preferably at least three (3) arcs with centers that lie within the pitch circle of the female rotor. The three (3) arcs are defined by a number of arcuate curves ($O_1$–J–K–L) smoothly connected to each other.

The designation that a portion of the rotor is referred to as an advancing profile is not meant to suggest that the rotor configuration can only be applied in compressors. This terminology was selected only so as to specify which of the two flanks on either side of the center of the crest of the addendum is being referred to. This embodiment as well as the third embodiment to be discussed below can also be applied to fluid pumps, blowers, or expanders.

In the first embodiment described above, the base portions of the dedendum of the male rotor, which correspond to the advancing profile of the addendum of the female rotor should have the shape of a generated curve matching the multiple arcuate curves.

A second embodiment of the invention according to the present invention concerns the retreating profiles of the addendum on the female rotor. The retreating profiles are shaped to prevent the occurrence of a state of semi-occlusion, which occurs in current related devices as described above, without reducing the strength of the female rotor or diminishing its theoretical displacement (i.e. theoretical draft). The second embodiment is characterized in that the retreating profile is defined by at least three (3) arcs, preferably at least three (3) arcs with centers that lie within the pitch circle. The three (3) arcs are defined by a number of arcuate curves (P–Q–R–S–$O_1$) smoothly connected to each other.

Of these several arcs, at least one (Q–R) of the arcs adjacent to the topmost arc and not extending as far as the pitch circle should have a radius substantially greater than that of the arc extending to the pitch circle (Q–P) of the female rotor.

The crest of each addendum of the female rotor includes a single arcuate curve (S–J), concentric with the shaft of the female rotor, which extends from the retreating side to the advancing side. The angle subtended by the arcuate curve is less than 4°.

As the state of semi-occlusion described above is primarily problematical in compressors, it follows that the second embodiment will be especially effective in compressors, fluid pumps and blowers.

In the second embodiment described above, a portion on each dedendum of the male rotor, which corresponds to the retreating profile on each addendum of the female rotor should have the form of a generated curve matching the several arcuate curves of the female rotor.

A third embodiment of the present invention has a rotor configuration to prevent both blowholes and the state of semi-occlusion. At a right angle to the shaft, a cross sectional profile of the addendum on the female rotor is defined by a number of arcuate curves (P–Q–R–J–K–L ) including at least five (5) arcs, and preferably the at least five (5) arcs have centers that lie within pitch circle of the female rotor.

The shape of each dedendum on the male rotor is a generated curve matching the several arcuate curves of the addendum of the female rotor.

The crest of the addendum on the female rotor are defined by a single arcuate curve (S–J), which are concentric with the shaft of female rotor 2 and extend from the retreating side to the advancing side. The angle subtended by the arcuate curve should be less than 4°.

The operation of the first embodiment of the present invention is as follows.

The blowhole illustrated in FIG. 3 will appear triangular when viewed in cross section along the A—A line in FIG. 6. If the addendum on the advancing surface of the female rotor 2 were cut parallel to its shaft and at the vertical surface passing through the point 5 at which the bores of the rotor cases intersect, curve AB would represent the edge of the cut surface. The curve BC would represent the edge if the crest of the male rotor were cut at its vertical surface. The straight line AC represents the ridge where the bores of the case intersect as viewed from a horizontal orientation. As FIG. 3 makes clear, the area of the blowhole can be reduced by causing curve AB to approach curve BC physically representing an increase degree of meshing between the male and female rotors.

In consideration of this point, we have designed this embodiment so that the advancing surface addendum on the female rotor comprise at least three (3) arcs with the result that the radius of curvature in the vicinity of point A will increase, and curve BA will be closer to curve BC. As can be seen in FIG. 3, the blowhole shown as $A_1$, $B_1$, $C_1$ has been substantially reduced in comparison to that of the rotor shown in the first example of the prior art, here labeled $A_2$, $B_2$, $C_2$.

In this embodiment, only the advancing profile of the addendum, which has little effect on the formation of the sealing line, is prescribed. Thus, it is possible to reduce the sealing line without affecting the shape of the addendum. This results in a substantial improvement in the total efficiency relative to the cubic volume.

In this embodiment, the addendum does not assume a complicated shape whose radius varies with the variation of the angle, as was described in the second example of a prior art rotor. Rather, it merely comprises several curves. This renders it simpler to manufacture than examples of the prior art.

The operation of the second embodiment according to the present invention will now be described.

The semi-occluded pocket tends to increase in size as the cylindrical angle Θ at the top of the female rotor becomes larger, as can be noted in FIGS. 2, 4 and 5. Conversely, such a pocket will not occur at all if this angle goes to zero. However, in the prior art rotors, designers feared mechanical damage if the addendum on the female rotor lacked a crest. They therefore flattened the curve of the crest and made either side from the tip of the crest to the pitch circle of the female rotor a single arc (See Japanese Patent Publications 2-46796 and 61-8242), or a generated curve corresponding to a single arc (See Japanese Patent Publication 2-50319).

However, when each lobe consists of a single arc and one attempts to decrease the crest angle, the result obtained in the third example of a prior art rotor is unavoidable. The strength of female rotor decreases and the theoretical displacement (i.e. theoretical draft) is diminished. No solution for this failing is found in the prior art.

In this embodiment, the crest angle is stipulated to be less than 4°. To enable the two opposed rotations to occur smoothly on a large scale, in this embodiment the advancing and retreating surfaces of the female rotor include at least three (3) arcs. More specifically, at least one (Q–R) of the one or several arcs adjacent to the topmost arc and not extending as far as the pitch circle is of a significantly greater radius than the other arc (Q–P), which does extend as far as pitch circle. In this way, smooth operation can be achieved.

When the crest of the tooth on the female rotor engages with the base of the tooth on male rotor, the escape path which communicates with the escape chamber created between the tooth surfaces of the two rotors becomes larger. No semi-occluded pocket is created, and the resultant compression does not occur. The function and reliability of the screw rotor are enhanced. Because the thickness of the tooth on the addendum of the female rotor is not diminished, the operation described above can be achieved without loss of strength in female rotor, or reduction of the theoretical displacement (i.e. theoretical draft).

DETAILED DESCRIPTION OF THE INVENTION

We shall next explain in detail, with reference to the Figures, a preferred embodiment according to the present invention. The dimensions, materials, shape and relative configuration of the components described in this embodiment are not described in detail, as this embodiment is illustrative, and is not meant to represent the complete range of this invention.

Figure 1:
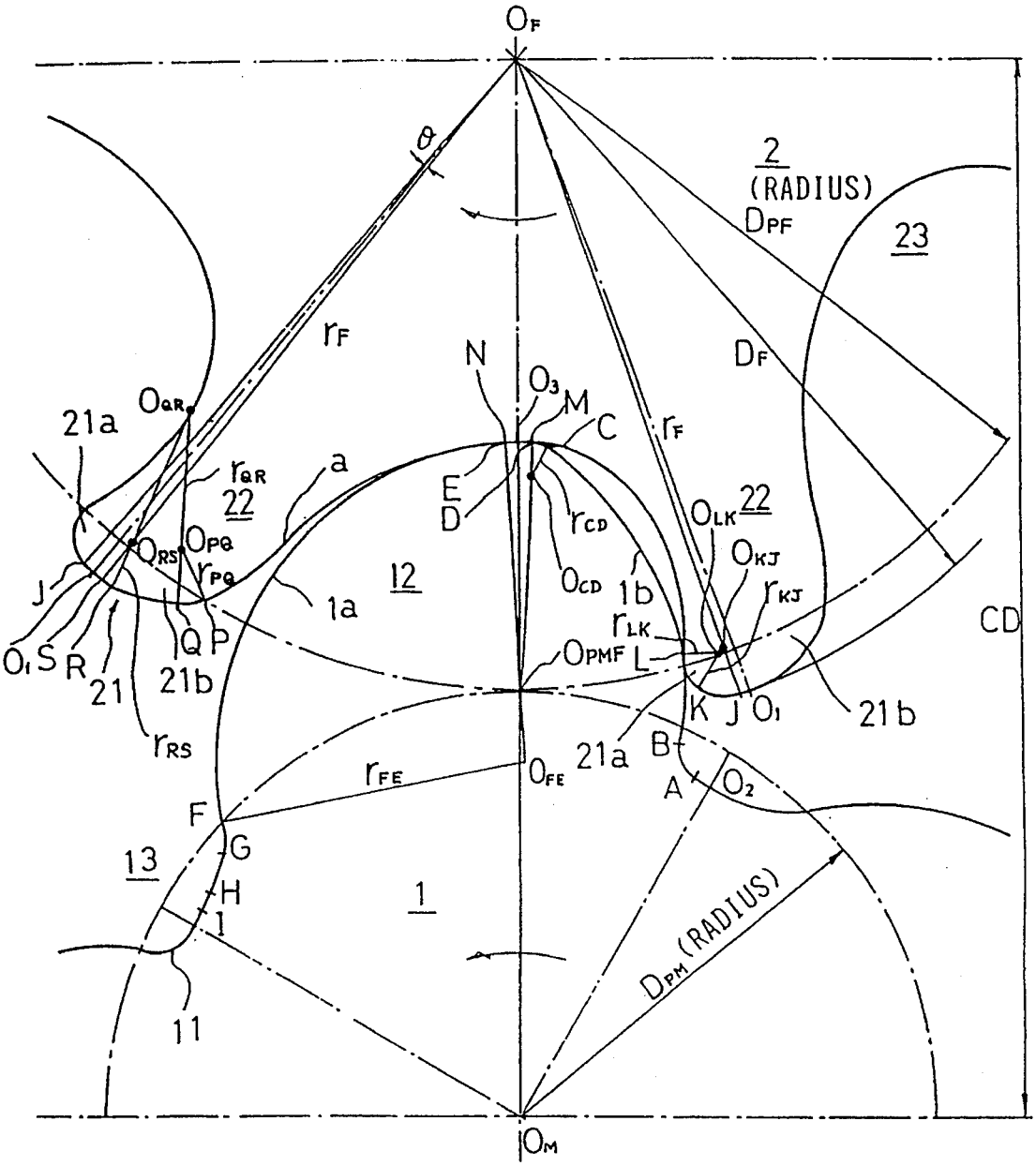
FIG. 1 is an enlarged transverse cross-sectional view of the essential parts of a screw rotor according to a preferred embodiment of the present invention.

FIG. 1 illustrates a preferred embodiment of this invention. It shows a cross-sectional view at a right angle to the shaft of the screw rotor when it is used as a screw-type compressor. The male rotor 1 has four (4) lands 12 positioned symmetrically at 90° angles. Between adjacent lands 12 is defined a trough 13 whose base extends into pitch circle $D_{pM}$. A portion of this base forms dedendum 11. This rotor is connected to a motor (not pictured) through a drive shaft and a series of gears so that it functions as the drive rotor, rotating in the direction shown by the arrow.

The female rotor 2 engaged by the male rotor 1, and includes six (6) lands 22 positioned symmetrically at 60° angles. Between adjacent lands 22 is a trough 23. An addendum 21 on each land 22 extends beyond the pitch circle $D_{pF}$. When it receives drive torque from the male rotor 1, the female rotor 2 is driven to rotate in the direction shown by the arrow.

The profiles of the teeth on the male and female rotors will now be described in detail.

The shape of the teeth on the advancing side of addendum 21 on female rotor 2 from the crest to the base in the advancing direction is defined by profile ($O_1$–J–K–L–M–$O_3$).

The segment $O_1$–J is defined by an arc of the circle whose center is the center $O_F$ of the shaft, and whose radius is $r_F$ ($D_F$).

The segment J–K, adjacent to the crest but not extending into the pitch circle, is defined by an arc of the circle whose center $O_{KJ}$ is within the pitch circle $D_{PF}$, and whose radius $r_{Kj}$ equals 0.036×CD, where CD is the distance from the center of the shaft of the rotor to the circle.

The segment K– L, extending to pitch circle $D_{PF}$, is defined by an arc of the circle whose center $O_{LK}$ is within pitch circle $D_{PF}$, and whose radius $r_{LK}$ equals 0.034×CD.

The segment L–M, which forms a trough extending from the pitch circle $D_{PF}$, is a curve generated by the arc C–D on male rotor 1*b*.

The segment M–N, which extends across the center of the base of the tooth, is defined by an arc of the circle whose center $O_{PMF}$ is the point $O_{PMF}$ of intersection of the two pitch circles on the line connecting the centers of the two shafts $O_F$ and $O_M$.

The segment $O_1$–J–K–L (extending as far as pitch circle $D_{PF}$) forms the advancing profile 21*a* of the addendum 21.

The shape of the tooth from the base back up to the crest on the retreating side of the addendum 21 of the female rotor 2 is the profile ($O_3$~N~P~Q~R~S~$O_1$).

The segment N–P, which extends from the base of the tooth to pitch circle $D_{PF}$, is defined by a curve generated by the arc EF of the male rotor 1*a*.

The segment P–Q, extending from pitch circle $D_{PF}$ and equivalent to the aforementioned fourth arc on addendum 21, consists of an arc whose center $O_{PQ}$ is a point within pitch circle $D_{PF}$ and whose radius $r_{PQ}$ equals 0.06×CD.

The segment Q–R, extending to the vicinity of the crest of the addendum 21 and equivalent to the third arc, is defined by an arc whose center $O_{QR}$ is a point within pitch circle $D_{PF}$, and whose radius $r_{QR}$ equals 0.15×CD.

The segment R–S, which adjoins the arc on the crest, is defined by an arc whose center $O_{RS}$ is a point within the pitch circle $D_{PF}$, and whose radius $r_{RS}$ equals 0.04×CD.

The segment $O_1$–S, which forms the crest of addendum 21, is defined by an arc whose center is the center $O_F$ of the shaft of the female rotor 2 and whose radius is $r_F$ (=$D_F$), The angle of the crest arc (S~J) of the addendum 21 on the female rotor 2 (i.e., the small angle Θ formed with the center $O_F$ of the shaft) is fixed at 1.4°.

The shape of the teeth on male rotor 1 is defined by profile ($O_2$~I~H~G~F~E~$O_3$) on the advancing side of male rotor 1.

The segment $O_2$–I of the dedendum 11 is a curve generated by the arc $O_1$–S of addendum 21 on female rotor 2.

The segment I–H of the dedendum 11 is a curve generated by the arc R–S of the addendum 21 on female rotor 2.

The segment H–G of dedendum 11 is a curve generated by the arc Q–R of addendum 21 on female rotor 2.

The segment G–F of dedendum 11 is a curve generated by the arc P–Q of the addendum 21 on female rotor 2.

The segment F–E, consisting largely of the advancing flank of the land on the male rotor 1, is an arc whose center $O_{FE}$ lies within pitch circle $D_{PM}$ and whose radius $r_{FE}$ equals 0.297×CD.

The shape of the tooth is defined by the profile ($O_3$~D~C~B~A~$O_2$) on the retreating side of male rotor 1.

The segment E–D, on the crest of the land of the male rotor 1, is an arc whose center $O_{pMF}$ is the point of intersection of the two pitch circles on the line connecting the centers of the two shafts $O_F$ and $O_M$, and whose radius $r_{MN}$ equals 0.238×CD.

The segment D–C, adjacent to the aforesaid crest, is an arc whose center $O_{CD}$ is on the line connecting the point $O_{PMF}$ of the two pitch circles with point M, and whose radius $r_{CD}$ equals 0.02×CD.

The segment C–B forms the major part of the retreating flank of the land of male rotor 1, and includes a portion of dedendum 11. It consists of a curve generated by arc K–L on female rotor 2.

The segment B–A of dedendum 11 is defined by a curve generated by arc J–K on female rotor 2.

The segment A–$O_2$, forming the apex of dedendum 11, is defined by a curve generated by arc $O_1$–S on female rotor 2.

Figure 2:
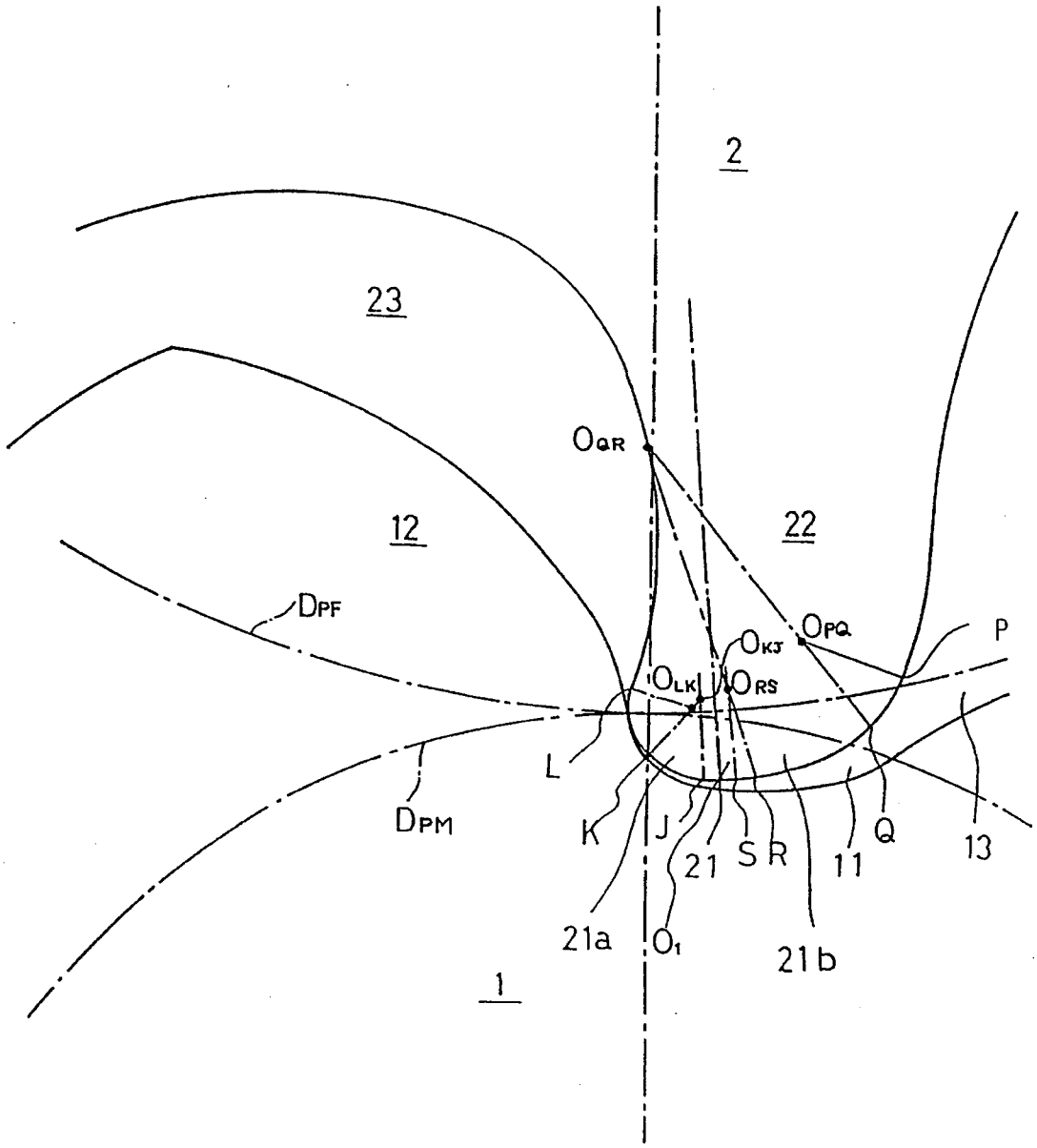
FIG. 2 is an enlarged transverse cross-sectional view showing the engagement of the female rotor with the male rotor, and particularly illustrates that a state of semi-occlusion does not occur.
Figure 3:
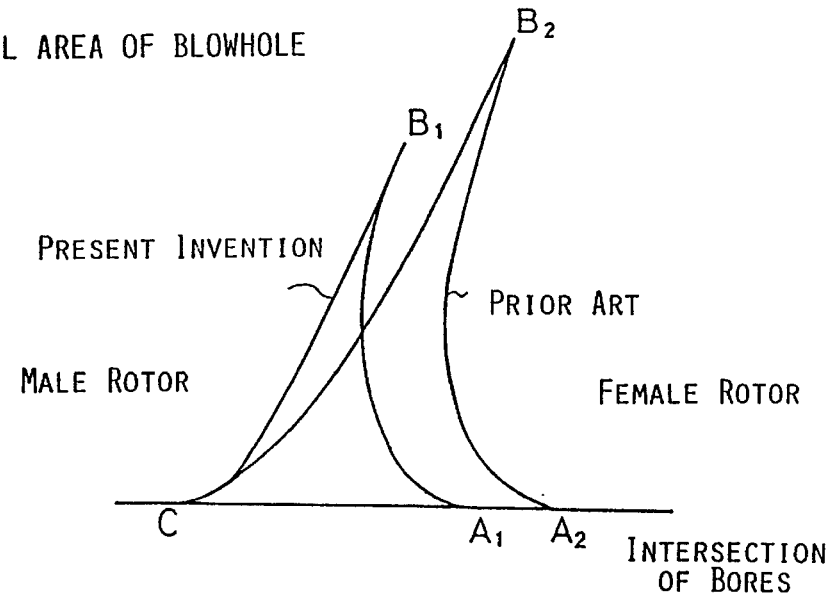
FIG. 3 is a functional diagram illustrating the area of the blowhole as viewed from line A—A in FIG. 6.
Figure 4:
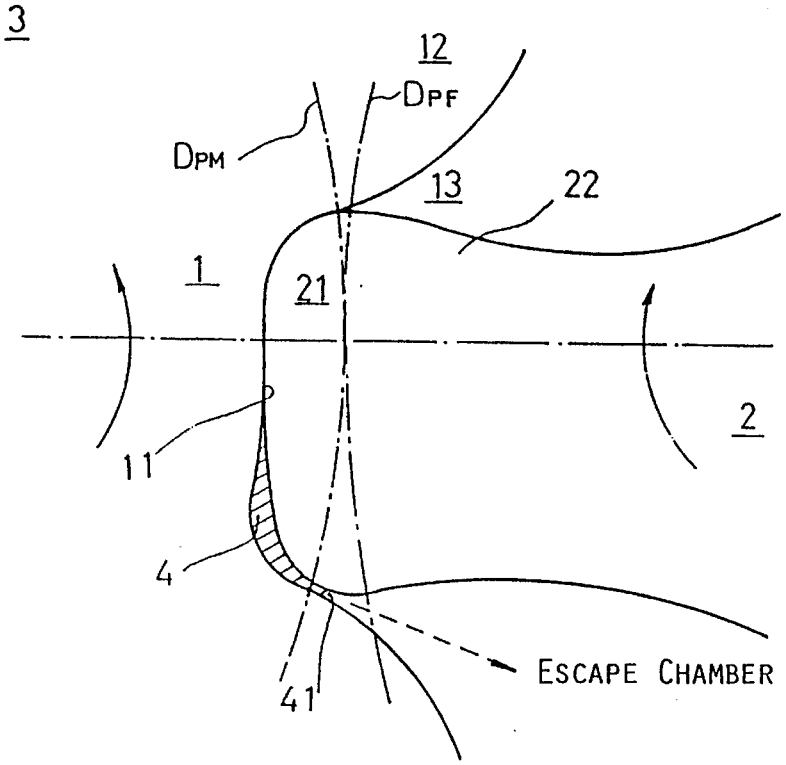
FIG.4 PRIOR ART
FIG. 4 shows the engagement of the male and female rotors in a prior art Example 1, and particularly illustrates the occurrence of a state of semi-occlusion.
Figure 5:
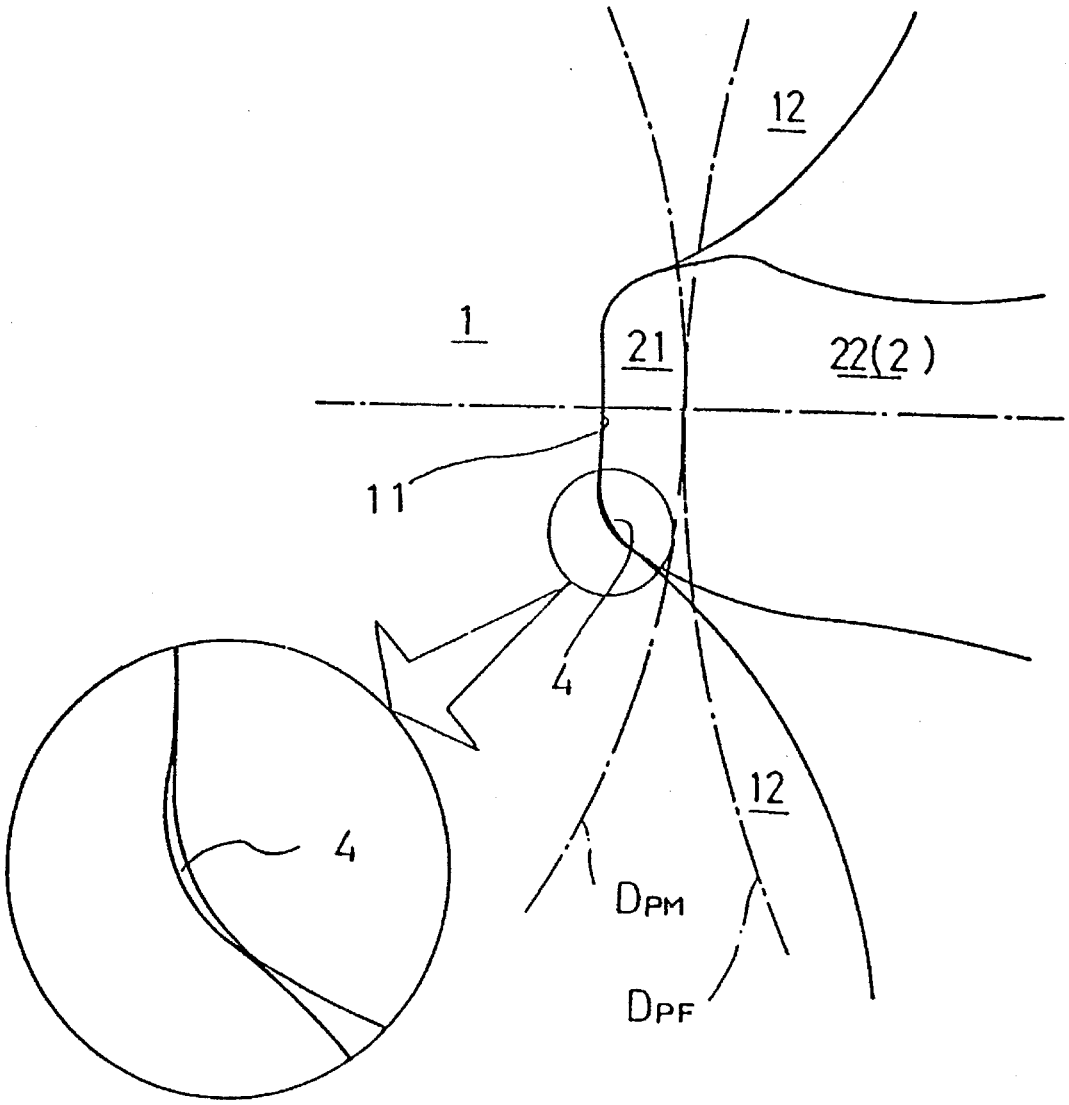
FIG.5 PRIOR ART
FIG. 5 shows the engagement of the male and female rotors in the prior art example 2, and particularly illustrates the occurrence of a state of semi-occlusion.
Figure 6:
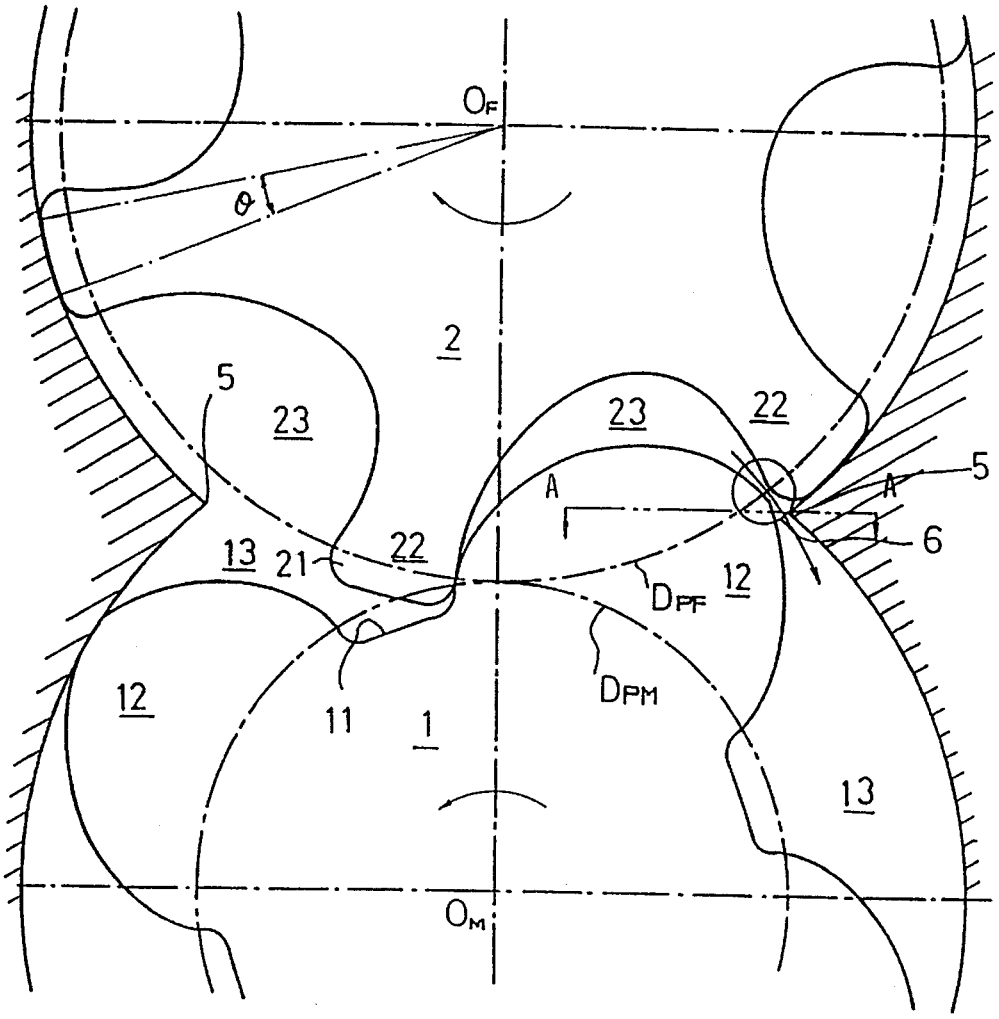
FIG.6 PRIOR ART
FIG. 6 is an enlarged transverse cross-sectional view of the essential parts of the screw rotor in prior art example 1, and shows the occurrence of a blowhole.

The configuration of the rotor described above allows unconstrained operation. More specifically, it results in a reduction of approximately 40% in the area of the blowhole when compared with the first example of a prior art rotor (Japanese Patent Publication 56-17559). Furthermore, the escape path which communicates with the escape chamber is substantially wider, as can be seen in FIG. 2. Thus, there is no semi-occluded pocket 4, and no useless compression. When this screw rotor is used in a compressor under identical conditions, the embodiment results in an improvement of approximately 5% in the compression efficiency over the compressor in the first example of a prior art rotor (Patent Publication 56-17559).

The profile of the retreating side of the female rotor is configured for eliminating the possibility of semi-occluded pockets between the addendum 21 of the female rotor and the dedendum 12 of the male rotor. In the preferred embodiment, the profile of the retreating side of the female rotor can be defined by a convolute having a decreasing radius when extending towards the pitch circle of the female rotor. This configuration and the matching configuration of the dedendum of the male rotor prevents the possibility of formation of semi-occluded pockets.

EFFECTS OF THE INVENTION

As was discussed above, the invention was conceived after attention was paid to the shape of the addendum on the female rotor and the dedendum on the male rotor, aspects of which that have not previously received sufficient consideration. By concentrating our efforts on the shapes of these components, we were able effectively reduce the area of the blowhole virtually without affecting the length of the sealing line.

The preferred embodiment according to the present invention concerns the use of the aforementioned rotor device as a compressor. It insures that during disengagement, the pocket enclosed by the surfaces of the teeth of the two rotors and the surface of the operating chamber does not become semi-occluded, and that the strength of the female rotor is not diminished nor the theoretical displacement (i.e. theoretical draft) reduced. Thus the aforementioned state of semi-occlusion can be prevented.

The preferred embodiment according to the present invention is able to fulfill all of the aforementioned effects. It succeeds in providing a screw rotor, which effectively improves the compression efficiency.

This invention is not limited to an oil jet-type rotor devices, but can be used in oil-less type rotors as well.

What is claimed is:

1. A screw rotor for a fluid handling device, comprising:

a housing having an operating chamber defined by two adjacent parallel cylindrical bores;

a male rotor disposed in one of said cylindrical bores, said male rotor having a plurality of troughs each having a dedendum located inside a pitch circle of said male rotor;

a female rotor disposed in the other cylindrical bore, said male and female rotors rotate together while engaging with each other, said female rotor having a plurality of lands having addendum located outside a pitch circle of said female rotor and engaging with said dedendum of said male rotor during operation, said female rotor having an advancing profile defined by a curve with at least three arcs located between a crest of said addendum and the pitch circle whereby increasing the degree of meshing between said male and female rotors and reducing the cross-sectional size of blowholes.

2. A screw rotor according to claim 1, wherein a segment of said dedendum of said male rotor corresponding to said advancing profile of said female rotor is provided with a profile defined by a generated curve matching said advancing profile of said female rotor.

3. A screw rotor for a fluid handling device, comprising:

a housing having an operating chamber defined by two adjacent parallel cylindrical bores;

a male rotor disposed in one of said cylindrical bores, said male rotor having a plurality of troughs each having a dedendum located inside a pitch circle of said male rotor;

a female rotor disposed in the other cylindrical bore, said male and female rotors rotate together while engaging with each other, said female rotor having a plurality of lands having addendum located outside a pitch circle of said female rotor and engaging with said dedendum of said male rotor during operation, said female rotor having an advancing profile defined by a curve with at least three arcs whereby increasing the degree of meshing between said male and female rotors and reducing the cross-sectional size of blowholes, said female rotor having a retreating profile defined by a curved with at least three arcs whereby eliminating formation of semi-occluded pockets between said addendum of said female rotor and said dedendum of said male rotor during rotation therebetween, said addendum of said female rotor having a crest defined by a single arc concentric with the shaft of said female rotor, and said crest extending between a retreating side and an adjacent advancing side of said addendum of said female rotor, said concentric crest subtends an angle less than 4°.

4. A screw rotor according to claim 3, wherein a segment of said dedendum of said male rotor which corresponds to said retreating profile of said female rotor is provided with a profile defined by a generated curve matching said curve following said retreating profile of said female rotor.

5. A screw rotor according to claim 3, wherein said at least three arcs of said curve defining said advancing profile of said female rotor are located between a crest of said addendum and the pitch circle.

6. A screw rotor comprising male and female rotors which rotate while engaging with each other, said female rotor having lands with each land having an addendum located outside of a pitch circle of said female rotor, said male rotor having troughs with each trough having a redendure located inside a pitch circle of said male rotor, wherein a cross-sectional profile of said addendum of said female rotor is a curve defined by at least five arcs, and a segment of said dedendum of said male rotor corresponding to said addendum of said female rotor is a generated curve following the profile of said female rotor, and a crest of said addendum of said female rotor consists of a single arc concentric with the shaft of said female rotor, said crest extending between a retreating side and an adjacent advancing side of said addendum, and an angle subtended by said crest is less than 4°.

7. A screw rotor according to claim 6, wherein said female rotor has a plurality of lands with addendum located outside a pitch circle of said female rotor and engaging with said dedendum of said male rotor during operation, said female rotor having an advancing profile defined by a curve having at least three arcs whereby reducing the cross-sectional size of blowholes.

8. A screw rotor according to claim 6, wherein said female rotor has a plurality of lands with addendum located outside a pitch circle of said female rotor and engaging with said dedendum of said male rotor during operation, said female rotor having a retreating profile defined by at least three arcs to eliminate formation of semi-occluded pockets between said addendum of said female rotor and said dedendum of said male rotor during rotation therebetween.

9. A screw rotor for a fluid handling device, comprising:

a housing having an operating chamber defined by two adjacent parallel cylindrical bores;

a male rotor disposed in one of said cylindrical bores, said male rotor having a plurality of troughs each having a dedendum located inside a pitch circle of said male rotor;

a female rotor disposed in the other cylindrical bore, said male and female rotors rotate together while engaging with each other, said female rotor having a plurality of lands having addendum located outside a pitch circle of said female rotor and engaging with said dedendum of said male rotor during operation, said female rotor having an advancing profile defined by a curve with at least three arcs whereby increasing the degree of meshing between said male and female rotors and reducing the cross-sectional size of blowholes, said female rotor having a retreating profile defined by a curved with at least three arcs whereby eliminating formation of semi-occluded pockets between said addendum of said female rotor and said dedendum of said male rotor during rotation therebetween, and one of said arcuate curves not extending as far as the pitch circle is defined by an arc with a significantly greater radius than an adjacent arc extending to the pitch circle of said female rotor.

10. A screw rotor according to claim 9, wherein a segment of said dedendum of said male rotor which corresponds to said retreating profile of said female rotor is provided with a profile defined by a generated curve matching said curve following said retreating profile of said female rotor.

* * * * *